US006035963A

United States Patent [19]

Wollitz

[11] Patent Number: 6,035,963

[45] Date of Patent: Mar. 14, 2000

[54] REFRIGERATION COMPRESSOR HAVING AN ASYMMETRICAL HOUSING FOR NOISE SUPPRESSION

[75] Inventor: John K. Wollitz, Tyler, Tex.

[73] Assignee: American Standard Inc., Piscataway, N.J.

[21] Appl. No.: 09/212,837

[22] Filed: Dec. 16, 1998

[51] Int. Cl.[7] ..... G10K 11/04

[52] U.S. Cl. ..... 181/200; 181/202; 181/198; 181/229; 181/212; 181/403; 181/204; 417/312; 417/902; 415/182.1; 62/296; 62/469; 62/508; D15/7; D15/9; D15/9.1

[58] Field of Search ..... 181/200, 202, 181/198, 229, 212, 403, 204; 417/312, 902; 415/182.1; 62/296, 469, 508; D15/7, 9, 9.1

[56] References Cited

U.S. PATENT DOCUMENTS

| | | | |
|---|---|---|---|
| D. 366,488 | 1/1996 | Alfano et al. | D15/9 |
| 3,187,995 | 6/1965 | Kjeldsen | 230/232 |
| 4,345,882 | 8/1982 | Saito et al. | 417/312 |
| 4,384,635 | 5/1983 | Lowery | 181/403 |
| 4,573,880 | 3/1986 | Hirano et al. | 417/312 |
| 4,729,723 | 3/1988 | Ontzem | 417/312 |
| 5,281,105 | 1/1994 | Osaka et al. | 417/312 |
| 5,391,054 | 2/1995 | Bush | 415/182.1 |
| 5,487,648 | 1/1996 | Alfano et al. | 417/312 |
| 5,538,404 | 7/1996 | DiFlora et al. | 417/312 |

*Primary Examiner*—Robert E. Nappi
*Assistant Examiner*—Edgardo San Martin
*Attorney, Agent, or Firm*—William J. Beres; William O'Driscoll; Peter D. Ferguson

[57] ABSTRACT

An upper housing shell of a hermetically sealed refrigeration compressor has a central asymmetrical section interposed between a lower cylindrical section and an upper spherical section. The shape of the central section is such that opposite points define a line that is perpendicular to the surface at one point, but is not perpendicular to the surface at the opposite point.

27 Claims, 4 Drawing Sheets

REFRIGERATION COMPRESSOR HAVING AN ASYMMETRICAL HOUSING FOR NOISE SUPPRESSION

BACKGROUND OF THE INVENTION

1. Field of the Invention

The subject invention generally pertains to a refrigeration compressor, and more specifically to the shape of the compressor's housing.

2. Description of Related Art

Refrigeration systems often include a compressor that is installed in a hermetically sealed housing. In many applications, it is important to minimize the noise generated by the compressor. Consequently, various housing designs have been developed to help attenuate the noise. One approach has been to provide a housing with an irregular shape to minimize resonance brought on by sound waves repeatedly reflecting between two facing surfaces of the housing.

For example, the housing of U.S. Pat. No. 4,729,723 arranges some opposite wall sections in a nonparallel relationship. These sections, however, do not appear to extend a significant distance around the circumference of the shell before being interrupted by parallel facing surfaces. In particular, it appears in FIG. 2 of the '723 patent, that section 5 directly faces section 6, and an upper portion of FIG. 2 faces a lower portion. It also appears, in FIG. 4, that the left side of upper shell 3 directly faces the right side. The '723 patent is just one example demonstrating the difficulty of achieving radial asymmetry that extends uninterrupted all the way around a compressor, without having the housing appear as though it were custom formed manually.

Another example is the housing of U.S. Pat. No. 5,281,105. FIG. 3 of the '105 patent not only shows a great deal of radial symmetry, but it also appears that point 43 directly faces point 44, and point 37 directly faces point 38.

The housing shown in FIG. 2 of U.S. Pat. No. 5,487,648 appears to have surface 16 directly facing surface 17. Also, the surface at the 10:30 position appears to directly face the surface at the 4:30 position. Any radially asymmetrical portions do not appear to extend much more than 45 degrees around the circumference of the housing before being interrupted by opposite parallel segments.

U.S. Pat. No. 4,345,882 is yet another example of a housing that attempts to address the noise issue, but the housing appears very symmetrical in FIG. 8, (which is a top view of FIG. 6). For a given horizontal plane, it also appears that points 14*a, b*, and *c* directly face 16*a, b*, and *c* respectively.

No horizontal cross-section is clearly shown for the compressor housing of U.S. Pat. No. 5,391,054; however, based on FIG. 6, it appears that any asymmetry lying along a horizontal plane extends less than halfway around upper shell 10.

SUMMARY OF THE INVENTION

To overcome the limitations of existing hermetic compressor housings, it is a primary object of the invention to provide an upper housing shell whose central surface is shaped such that opposite points define a line that is perpendicular to the surface at one point, but is not perpendicular to the surface at the opposite point, both horizontally and vertically.

A second object of the invention is to extend the feature just described with reference to the primary object at least 180 degrees uninterrupted around the housing (along a horizontal plane).

A third object is to achieve the aforementioned primary object by having the central surface curve about various horizontal axes at radii that vary with the circumferential position around the housing.

A fourth object is to achieve the third object by having the various horizontal axes share a common horizontal plane, so that a radially asymmetrical portion of the housing can be blended to a cylindrical portion of the housing.

A fifth object is to interpose a radially asymmetrical portion of the housing between a lower cylindrical portion and an upper spherical portion.

A sixth object is to tilt the upper spherical portion out of level, i.e. a non-horizontal tangent plane passes through a point at the spherical portion's centroid (i.e., center of area).

A seventh object is to provide an asymmetrical housing with curved transitional segments that blend adjacent segments of different radii.

An eighth object is to have the compressor housing contain an oil supply not only to lubricate the compressor, but also to help dampen noise reflected within the housing.

These and other objects of the invention are provided by a novel compressor housing having an upper housing shell with an asymmetrical portion that is shaped such that opposite points define a line that is perpendicular to the surface at one point, but is not perpendicular to the surface at the opposite point, both horizontally and vertically. The asymmetrical portion along a horizontal plane extends at least 180 degrees uninterrupted around the housing.

DESCRIPTION OF PREFERRED EMBODIMENT

Figure 1:
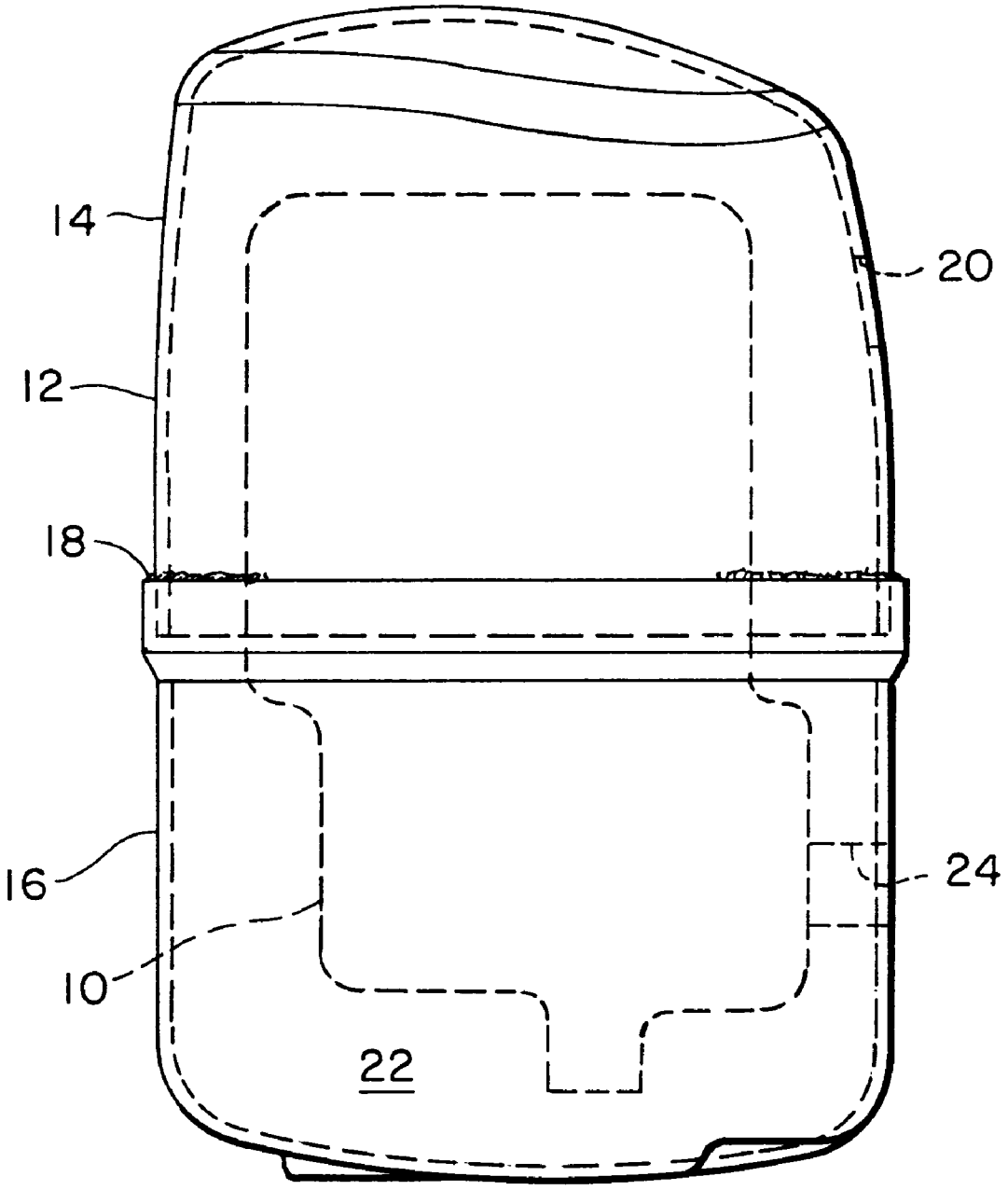
FIG. 1 is a front view of the invention.

Referring to FIG. 1, a refrigeration compressor 10 is shown contained within a hermetically sealed housing 12. Housing 12 has an upper shell 14 welded along joint 18 to a lower shell 16. Upper shell 14 has a suction port 20 that supplies refrigerant to compressor 10. Lower shell 16 contains an oil supply 22 for lubricating compressor 10 and is open ended and generally cylindrical at the location of its attachment of upper shell 14. Lower shell 16 also has a discharge port 24 through which compressor 10 discharges refrigerant. Ports 20 and 24 serve to couple compressor 10 to a conventional hermetically sealed refrigeration circuit.

Figure 2:
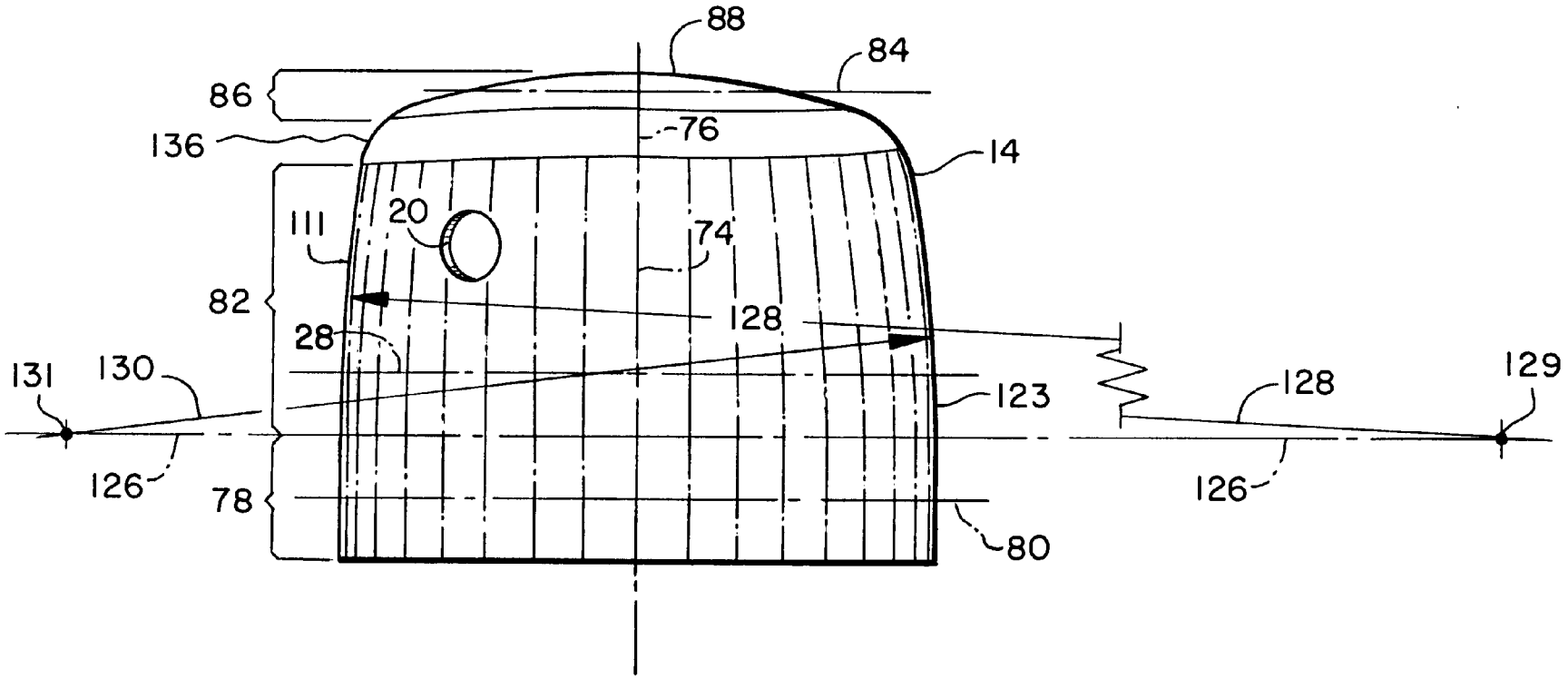
FIG. 2 is generally a right side view of the upper shell.
Figure 3:
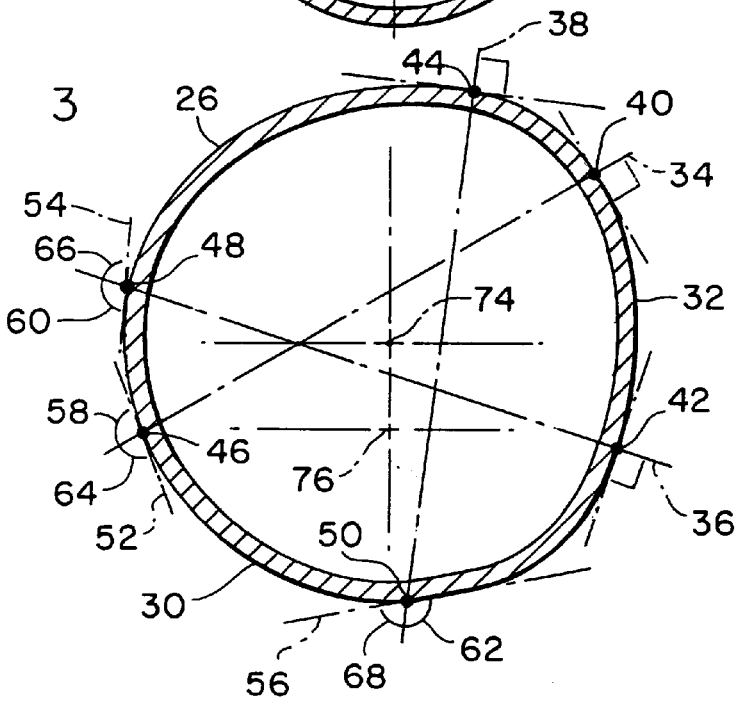
FIG. 3 is a cross-section at plane 28 of FIG. 2.

Referring to FIGS. 2 and 3, upper shell 14 has at least one middle horizontal cross-section 26 that lies in a horizontal plane 28 to define an annular curve 30. Curve 30 includes a continuous, uninterrupted section 32 that runs more than halfway around the circumferential length of curve 30. In this exemplary embodiment of the invention, section 32 actually extends 360 degrees around curve 30. A projection line 34, 36, or 38 extending horizontally (i.e., coplanar with plane 28) at a right angle from any point 40, 42, or 44 (respectively) along section 32 intersects an opposite point 46, 48, or 50 (respectively) along curve 30 to intersect a tangent 52, 54, or 56 (respectively). Lines 34, 36, and 38 intersect their respective tangents 52, 54, and 56 at an angle other than 90 degrees, so that each intersection creates both an obtuse angle 58, 60, or 62 and an acute angle 64, 66, or 68.

Figure 4:
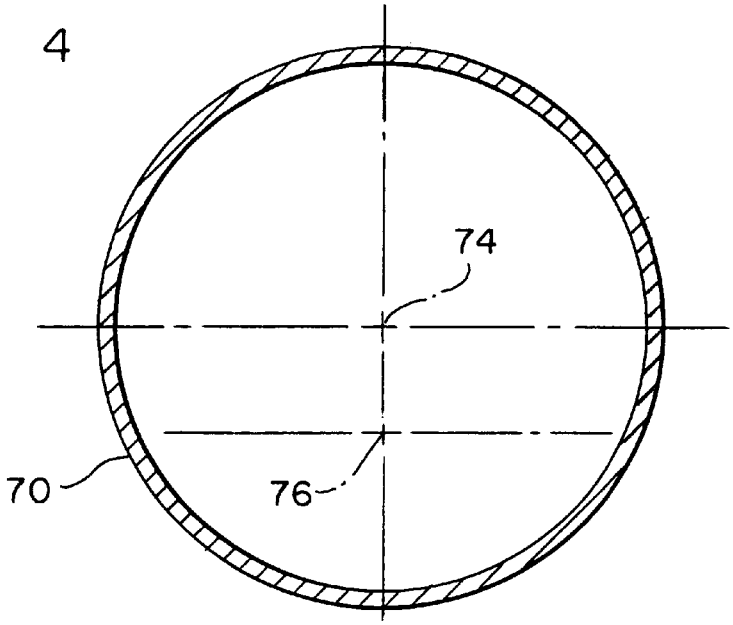
FIG. 4 is a cross-section at plane 80 of FIG. 2.
Figure 5:
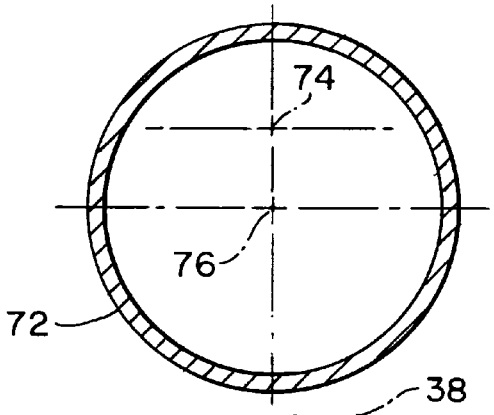
FIG. 5 is a cross-section at plane 84 of FIG. 2.

Upper shell 14 of FIG. 2 also includes a lower horizontal cross-section 70 (FIG. 4) and an upper horizontal cross-section 72 (FIG. 5). With the exception of port 20 and other miscellaneous features, most of lower cross-section 70 is radially symmetrical about a first substantially vertical center line 74, most of upper cross-section 72 is radially symmetrical about a second substantially vertical centerline 76, and most of middle cross-section 26 is radially asymmetrical about centerline 74 and 76. Centerlines 74 and 76 can also be seen in FIG. 6.

Lower cross-section 70 lies along a horizontal plane 80 lies across a section that is referred to as a lower section 78 of upper shell 14. Lower section 78 is substantially cylindrical. Middle cross-section 26 lies within middle section 82 of upper shell 14. Middle section 82 is generally of changing asymmetric cross-section along the majority of its length yet is generally situated about centerline 74. Upper cross-section 72 lies along a horizontal plane 84 that is within an upper section 86 of upper shell 14.

Upper section 86 is a tilted substantially spherical surface area 88 whose center of area is referred to as a centroid 90. Centroid 90 can be looked upon as a balance point upon which area 88 alone (separate from the remainder of shell 14) might balance on a pin point. Centroid 90 is offset to centerline 76 (see FIG. 7), such that a plane 92 passing through centroid 90 and tangent to spherical surface area 88 is tilted out of parallel to horizontal plane 84, as shown in FIG. 6.

In the preferred embodiment, the geometry of middle section 82 can be viewed as comprising a first twelve vertically curved segments 101–112, each one of which is associated with a corresponding opposing vertically curved segment 113–124 respectively. As will be appreciated, the use of more or fewer such segments is contemplated as being within the scope of the present invention. The term "vertically curved", as used herein and below, refers to curving that occurs generally about a horizontal axis at a radius of greater than zero but up to and including infinity (i.e., a vertical, planar segment). Sections 101–112 are generally spaced 180 degrees from their respective opposing segments 113–124 as measured circumferentially about centerline 74 and each of vertically curved segments 101–112 has a larger radius of curvature than does its corresponding and opposing vertically curved segment 113–124.

The centers of the radius of curvatures of segments 101–124 are all located on a common substantially horizontal plane 126. For example, in FIG. 2, segment 111 has a radius of curvature 128 of 85 inches while corresponding opposing segment 123 has a radius of curvature 130 of 14.37 inches. Centers 129 and 131 of radius of curvatures 128 and 130 both lie on plane 126 as do the centers of the radius of curvatures of the other segments.

Figure 6:
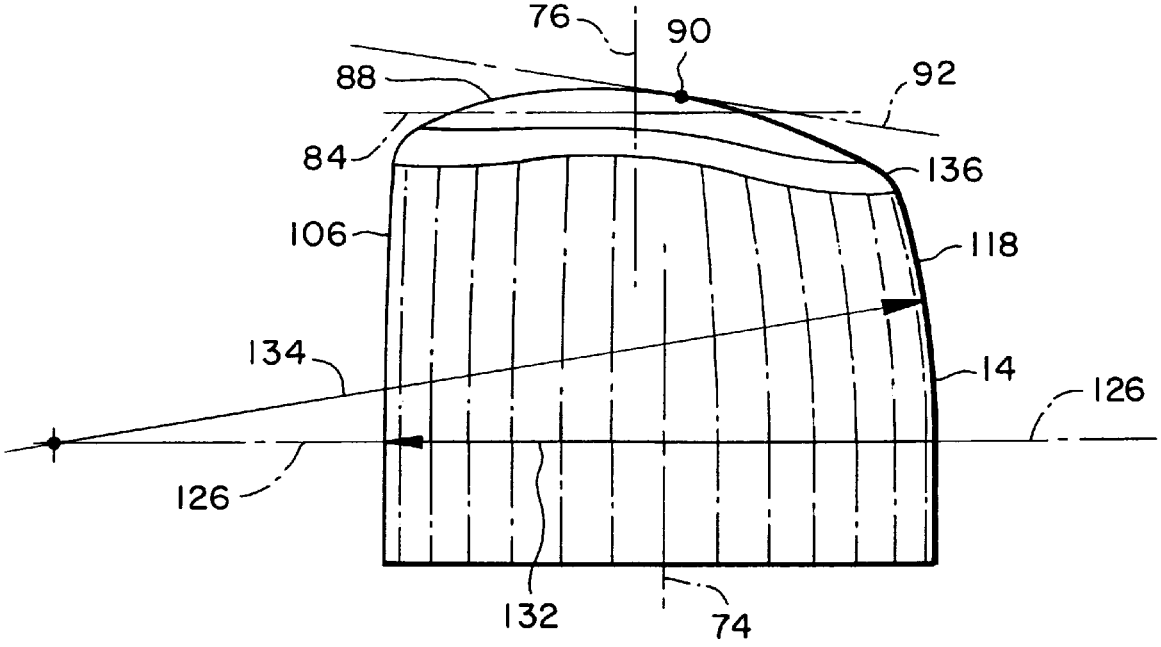
FIG. 6 is another side view of the upper shell.
Figure 7:
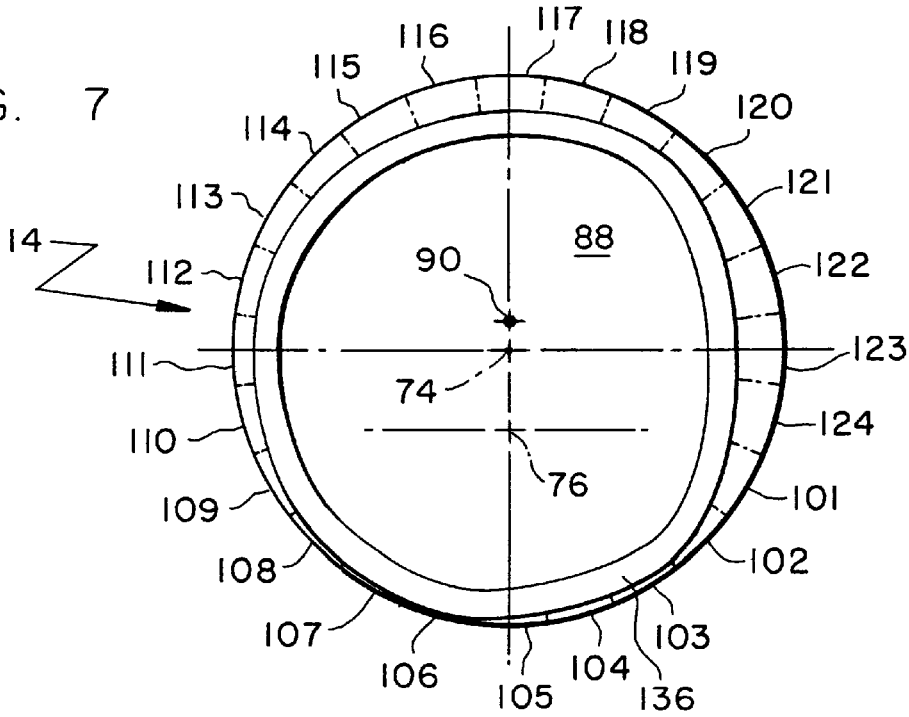
FIG. 7 is a top view of the upper shell.

As another example, in FIG. 6, segment 106 has a radius of curvature 132 of infinity (i.e., a vertical wall) while corresponding opposing segment 118 has a radius of curvature 134 of 14.5 inches. By having the radius of curvatures of segments 101–124 all have centers located on a common substantially horizontal plane 126, the blending of middle asymmetrical section 82 of upper shell 14 to substantially cylindrical lower section 78, at the location where lower section 78 and middle asymmetric middle section 82 meet, is facilitated.

In one embodiment of the invention the radius of curvature of each segment is as follows: 101 is 19.75 inches, 102 is 24.89 inches, 103 is 33.38 inches, 104 is 36 inches, 105 is 49.53 inches, 106 is infinity, 107 is infinity, 108 is infinity, 109 is 85 inches, 110 is 85 inches, 111 is 85 inches, 112 is 33.38 inches, 113 is 17.5 inches, 114 is 13.35 inches, 115 is 12.34 inches, 116 is 12.34 inches, 117 is 13.35 inches, 118 is 14.5 inches, 119 is 13.35 inches, 120 is 12 inches, 121 is 11.47 inches, 122 is 11.9 inches, 123 is 14.37 inches, and 124 is 16.7 inches. This particular embodiment includes a first transitional vertically curved segment 101 and a second transitional vertically curved segment 112. Segment 101 lies adjacent to corresponding opposing vertically curved which is in opposing correspondence with segment 112. Segment 112 lies adjacent to vertically curved section 113 which is in opposing correspondence with segment 101.

Any two adjacent segments 101–124, their respective radii of curvature being different (but not so different as to create significant discontinuities in the surface of upper shell 14 from one segment to the next), are blended where they meet to create a generally smooth shell surface. Likewise a 0.625 radius at a blended region 136 is used in blending asymmetrical middle section 82 to tilted upper spherical section 86.

Although the invention is described with respect to a preferred embodiment, modifications thereto will be apparent to those skilled in the art. Therefore, the scope of the invention is to be determined by reference to the claims, which follow.

What is claimed is:

1. A housing for containing a compressor, said housing comprising:

a lower shell having a generally cylindrical open end; and an upper shell joined to said lower shell, said upper shell including a lower section, an upper section and a middle section disposed therebetween, said lower section being defined about a vertical axis and being generally cylindrical to accommodate the attachment of said upper shell to said open end of said lower shell, said middle section being of a continuously changing asymmetric cross-section for at least the majority of its length along said axis, said upper section being spherical and tilted with respect to said axis.

2. The housing according to claim 1 wherein said middle section of said upper shell transitions from a generally asymmetric cross-section to a cylindrical cross-section in the horizontal plane where said middle section of said upper shell is joined to said lower section of said upper shell.

3. The housing according to claim 1 further comprising a blended upper shell portion, said blended upper shell portion being disposed between said asymmetric middle section of said upper shell and said tilted spherical upper section of said shell.

4. The housing according to claim 1 wherein the centroid of said tilted upper spherical section of said upper shell is disposed on a line which is parallel to but offset from said vertical axis.

5. The housing according to claim 1 wherein said middle section of said upper shell is comprised of a plurality of adjacent vertically curved segments, the centers of the radii of said curved segments being located on a common plane which is perpendicular to said vertical axis and which is generally coincident with the plane where said lower section of said upper shell meets said middle section of said upper shell.

6. The housing according to claim 5 wherein the radius of curvature of a majority of adjacent ones of said curved segments are different.

7. The housing according to claim 5 wherein said plurality of curved segments is even in number and wherein opposing pairs of said curved segments each have a different radius of curvature.

8. The housing according to claim 5 wherein said plurality of curved segments includes a first portion of adjacent ones thereof and a second portion of adjacent ones thereof, the radius of curvature of each of said first portion of adjacent ones of said curved segments being larger than the radius of curvature of any one of said second portion of adjacent ones thereof.

9. The housing according to claim 5 wherein among said plurality of curved segments is at least one curved segment having a radius of curvature of infinity so that said at least one curved segment parallels said vertical axis.

10. The housing according to claim 9 wherein more than one of said curved segments has a radius of curvature of infinity, all such segments being adjacent one another.

11. The housing according to claim 5 wherein said plurality of adjacent vertically curved segments is comprised of a first portion of curved segments and a second portion of curved segments, said first portion of curved segments all having radii of curvature greater than the radii of curvature of any one of said second portion of curved segments and said first portion of curved segments including at least two adjacent curved segments each having radii of curvature of infinity such that said at least two adjacent segments parallel said axis.

12. A housing for containing a compressor, said housing comprising:

a lower shell containing an oil supply for said compressor; and an upper shell joined to said lower shell, said upper shell having a cross-section lying in a substantially horizontal plane to define an annular curve most of which comprises a continuous section such that a substantially horizontal line extending at a right angle from any one point along said continuous section and perpendicular to said annular curve at said point intersects an opposite point along said annular curve to create an obtuse and an acute angle with a line tangent to said annular curve at said opposite point.

13. The housing as recited in claim 12, wherein said upper shell has a plurality of vertically curved sections each of which are associated with a corresponding opposing vertically curved section, each of said plurality of vertically curved sections having a larger radius of curvature than a radius of curvature of said corresponding opposing vertical curved section with said radius of curvature and said larger radius of curvature each having a center of radius sharing a common substantially horizontal plane.

14. The housing as recited in claim 12, wherein said upper shell has a plurality of vertically curved sections each of which are associated with a corresponding opposing vertically curved section, each of said plurality of vertically curved sections having a larger radius of curvature that is larger than a radius of curvature of said corresponding opposing vertically curved section, said plurality of vertically curved sections including a first transitional vertically curved section and a second transitional vertically curved section, said first transitional vertically curved section lying adjacent to said corresponding opposing vertically curved section associated with said second transitional vertically curved section, and said second transitional vertically curved section lying adjacent to said corresponding opposing vertically curved section associated with said first transitional vertically curved section.

15. The housing as recited in claim 12, wherein said upper shell includes a lower horizontal cross-section, an upper horizontal cross-section, and a middle horizontal cross-section between said lower horizontal cross-section and said upper horizontal cross-section, most of said lower horizontal cross-section being radially symmetrical about a first substantially vertical centerline, most of said upper horizontal cross-section being radially symmetrical about a second substantially vertical centerline that is offset to said first substantially vertical centerline, and most of said middle horizontal cross-section being radially asymmetrical about both said first substantially vertical centerline and said second substantially vertical centerline.

16. The housing as recited in claim 15, wherein said lower horizontal cross-section and said upper horizontal cross-section are substantially circular, while most of said middle horizontal cross-section is radially asymmetrical.

17. The housing as recited in claim 12, wherein said upper shell includes a lower section, an upper section, and a middle section between said lower section and said upper section, most of said middle section being disposed radially asymmetrically about a substantially vertical centerline, said upper section having a substantially spherical surface area that has a center of radius that is offset to said substantially vertical centerline, said substantially spherical surface area has a centroid that is also offset to said substantially vertical centerline, such that a plane passing through said centroid and tangent to said substantially spherical surface area is tilted out of parallel with said substantially horizontal plane.

18. A housing for containing a compressor, said housing comprising:

a lower shell containing an oil supply for said compressor; and an upper shell joined to said lower shell, said upper shell having a plurality of vertically curved sections each of which are associated with a corresponding opposing vertically curved section, each of said plurality of vertically curved sections having a radius of curvature that is larger than a radius of curvature of said corresponding opposing vertically curved section, said plurality of vertically curved sections including a first transitional vertically curved section and a second transitional vertically curved section, said first transitional vertically curved section lying adjacent to said corresponding opposing vertically curved section associated with said second transitional vertically curved section, and said second transitional vertically curved section lying adjacent to said corresponding opposing vertically curved section associated with said first transitional vertically curved section.

19. The housing as recited in claim 18, wherein said upper shell has a middle cross-section lying in a substantially horizontal plane to define an annular curve most of which comprises a continuous section such that a substantially horizontal line extending at a right angle from any one point along said continuous section and perpendicular to said annular curve at said point intersects an opposite point along said annular curve to create an obtuse and an acute angle with a line tangent to said annular curve at said opposite point.

20. The housing as recited in claim 18, wherein said radius of curvature and said larger radius of curvature each have a center of radius sharing a common substantially horizontal plane.

21. The housing as recited in claim 18, wherein said upper shell includes a lower horizontal cross-section, an upper horizontal cross-section, and a middle horizontal cross-section between said lower horizontal cross-section and said upper horizontal cross-section, most of said lower horizontal cross-section being radially symmetrical about a first substantially vertical centerline, most of said upper horizontal cross-section being radially symmetrical about a second substantially vertical centerline that is offset to said first substantially vertical centerline, and most of said middle horizontal cross-section being radially asymmetrical about both said first substantially vertical centerline and said second substantially vertical centerline.

22. The housing as recited in claim 21, wherein said lower horizontal cross-section and said upper horizontal cross-section are substantially circular.

23. The housing as recited in claim 18, wherein said upper shell includes a lower section, an upper section, and a middle section between said lower section and said upper section, most of said middle section being disposed radially asymmetrically about a substantially vertical centerline, said upper section having a substantially spherical surface area that has a center of radius that is offset to said substantially vertical centerline, said substantially spherical surface area having a centroid that is also offset to said substantially vertical centerline, such that a plane passing through said centroid and tangent to said substantially spherical surface area is tilted out of perpendicularity with said substantially vertical centerline.

24. A method of configuring an upper shell of a housing that is adapted to contain a compressor, comprising:

blending an asymmetric middle section to a lower section that is substantially symmetrical about a longitudinal centerline; and blending said asymmetrical middle section to a substantially symmetrical upper section.

25. The method of claim 24, wherein said lower section is substantially cylindrical.

26. The method of claim 25, wherein said substantially symmetrical upper section includes a substantially spherical surface area.

27. The method of claim 26, comprising the further step of tilting said substantially spherical surface area, whereby a plane passing through a centroid of said substantially spherical surface area and tangent to said substantially spherical surface area creates an acute angle to said longitudinal centerline of said lower section.

* * * * *